US011992881B2

(12) United States Patent
Lyons et al.

(10) Patent No.: US 11,992,881 B2
(45) Date of Patent: May 28, 2024

(54) SELECTIVELY LEACHED THERMALLY STABLE CUTTING ELEMENT IN EARTH-BORING TOOLS, EARTH-BORING TOOLS HAVING SELECTIVELY LEACHED CUTTING ELEMENTS, AND RELATED METHODS

(71) Applicant: Baker Hughes Oilfield Operations LLC, Houston, TX (US)

(72) Inventors: Nicholas J. Lyons, Houston, TX (US); Marc Bird, Houston, TX (US); Andrew Robertson, The Woodlands, TX (US)

(73) Assignee: Baker Hughes Oilfield Operations LLC, Houston, TX (US)

( * ) Notice: Subject to any disclaimer, the term of this patent is extended or adjusted under 35 U.S.C. 154(b) by 120 days.

(21) Appl. No.: 17/510,193

(22) Filed: Oct. 25, 2021

(65) Prior Publication Data

US 2023/0129943 A1 Apr. 27, 2023

(51) Int. Cl.

| | |
|---|---|
| ***E21B 10/56*** | (2006.01) |
| ***B22F 7/06*** | (2006.01) |
| ***E21B 10/46*** | (2006.01) |
| ***E21B 10/567*** | (2006.01) |

(52) U.S. Cl.

CPC ..... *B22F 7/064* (2013.01); *E21B 10/46* (2013.01); *E21B 10/567* (2013.01); *B22F 2302/406* (2013.01); *B22F 2998/10* (2013.01)

(58) Field of Classification Search

CPC ..... E21B 10/567; E21B 10/46; B22F 7/064; B22F 2302/406

See application file for complete search history.

(56) References Cited

U.S. PATENT DOCUMENTS

| | | | |
|---|---|---|---|
| 8,061,456 | B2 | 11/2011 | Patel et al. |
| 8,887,838 | B2 | 11/2014 | Stowe, II |
| 9,657,529 | B1 | 5/2017 | Bertagnolli et al. |
| 9,845,642 | B2 | 12/2017 | Stockey |

(Continued)

OTHER PUBLICATIONS

International Search Report for International Application No. PCT/US2022/078386 dated Feb. 14, 2023, 3 pages.

(Continued)

*Primary Examiner* — Cathleen R Hutchins
(74) *Attorney, Agent, or Firm* — TraskBritt

(57) ABSTRACT

A cutting element comprises a supporting substrate, and a cutting table attached to an end of the supporting substrate. The cutting table comprises a first region and a second region. The first region comprising inter-bonded diamond particles and is substantially free of at least highly catalytic metallic compounds, one or more non-catalytic compounds within interstitial spaces between the inter-bonded diamond particles, and voids within interstitial spaces between the inter-bonded diamond particles. The second region comprising inter-bonded diamond particles, one or more non-catalytic compounds within interstitial spaces between the inter-bonded diamond particles, and one or more metallic phases within interstitial spaces between the inter-bonded diamond particles. The first region of the cutting table has a content of elemental metal of at least about 2.6 wt %. A method of forming a cutting element, and an earth-boring tool are also described.

20 Claims, 8 Drawing Sheets

(56) References Cited

U.S. PATENT DOCUMENTS

| | | | | |
|---|---|---|---|---|
| 9,845,652 | B2 | 12/2017 | Wolfe et al. | |
| 10,465,447 | B2 | 11/2019 | Stockey et al. | |
| 10,590,710 | B2 | 3/2020 | Vempati et al. | |
| 10,954,721 | B2 | 3/2021 | Russell et al. | |
| 2005/0263328 | A1* | 12/2005 | Middlemiss | B22F 7/06 175/434 |
| 2009/0133938 | A1 | 5/2009 | Hall et al. | |
| 2010/0242375 | A1* | 9/2010 | Hall | B22F 3/14 51/307 |
| 2015/0197991 | A1 | 7/2015 | Digiovanni et al. | |
| 2017/0191316 | A1 | 7/2017 | Stockey et al. | |
| 2017/0254153 | A1* | 9/2017 | Bird | B24D 18/0009 |
| 2018/0328117 | A1* | 11/2018 | Bird | B22F 7/06 |
| 2019/0203541 | A1 | 7/2019 | Bird et al. | |
| 2019/0368278 | A1 | 12/2019 | Cao et al. | |
| 2021/0245244 | A1 | 8/2021 | Robertson et al. | |

OTHER PUBLICATIONS

International Written Opinion for International Application No. PCT/US2022/078386 dated Feb. 14, 2023, 5 pages.

* cited by examiner

| Part | Region | Normalized Metal Content | | | Total Metal Content (wt%) |
|---|---|---|---|---|---|
| | | Co | Al | W | |
| Conventional Cutting Element | Non-Leached | 1 | - | 1 | 8.85 |
| | Leached | 0.24 | - | 0.44 | 2.45 |
| Selectively Leached Cutting Element | Non-Leached | 1 | 1 | 1 | 9.51 |
| | Leached | 0.35 | 0.50 | 2.36 | 5.09 |

SELECTIVELY LEACHED THERMALLY STABLE CUTTING ELEMENT IN EARTH-BORING TOOLS, EARTH-BORING TOOLS HAVING SELECTIVELY LEACHED CUTTING ELEMENTS, AND RELATED METHODS

TECHNICAL FIELD

Embodiments of the disclosure relate to cutting elements, earth-boring tools, and methods of forming the cutting elements.

BACKGROUND

Earth-boring tools for forming wellbores in subterranean earth formations may include a plurality of cutting elements secured to a body. For example, fixed-cutter earth-boring rotary drill bits (e.g., drag bits) include a number of cutting elements fixedly attached to a bit body of a drill bit and configured for removing formation material with a shearing action that are. Similarly, roller cone earth-boring rotary drill bits may include member (e.g., cones) that are mounted on bearing pins extending from legs of a bit body such that each cone is rotatable about the bearing pin on which it is mounted. Cutting elements in the form of so-called "inserts" configured for a crushing and gouging action to remove subterranean formation material may be mounted to each cone of the drill bit. Other earth-boring tools utilizing one or more types of cutting elements include, for example, core bits, bi-center bits, eccentric bits, hybrid bits (e.g., rolling components in combination with fixed cutting elements), reamers, and casing milling tools.

The cutting elements used in such earth-boring tools often include a volume of superabrasive material, typically in the form of polycrystalline diamond ("PCD") material mounted on and bonded to a supporting substrate. Surfaces of the polycrystalline diamond act as cutting faces of the so-called polycrystalline diamond compact ("PDC") cutting elements. PCD material is material that includes inter-bonded grains or crystals of diamond material. In other words, PCD material includes direct, inter-granular bonds between the grains or crystals of diamond material. The terms "grain" and "crystal" are used synonymously and interchangeably herein.

PDC cutting elements are conventionally formed by sintering and bonding together relatively small diamond (synthetic, natural or a combination) grains, termed "grit," under conditions of high temperature and high pressure in the presence of a Group VIII metal catalyst (e.g., cobalt, iron, nickel, or alloys and mixtures thereof) to form one or more layers (e.g., a "compact" or "table") of PCD material. These processes are often referred to as high temperature/high pressure (or "HTHP") processes. The supporting substrate may comprise a cermet material (e.g., a ceramic-metal composite material) such as, for example, cobalt-cemented tungsten carbide. In some instances, the PCD material may be formed on the cutting element, for example, during the HTHP process. In such instances, catalyst material (e.g., cobalt) in the supporting substrate may be "swept" into the diamond grains during sintering and serve as a catalyst material for forming the diamond table from the diamond grains. Powdered catalyst material may also be mixed with the diamond grains prior to sintering the grains together in an HTHP process. In other methods, the diamond table may be formed separately from the supporting substrate and subsequently attached thereto, for example by brazing.

Upon formation of a diamond table using a conventional HTHP process and conventional catalyst materials, catalyst material may remain in interstitial spaces between the grains or crystals of diamond in the resulting polycrystalline diamond table. The presence of the catalyst material in the diamond table may contribute to thermal damage in the diamond table when the cutting element is heated during use due to friction at the contact point between the cutting element and the formation. Polycrystalline diamond cutting elements in which the catalyst material remains in the diamond table are generally thermally stable up to a temperature of about seven hundred fifty degrees Celsius (750° C.), although internal stress within the polycrystalline diamond table may begin to develop at temperatures exceeding about three hundred fifty degrees Celsius (350° C.). This internal stress is at least partially due to differences in the rates of thermal expansion between the diamond table and the cutting element substrate to which it is bonded. This differential in thermal expansion rates may result in relatively large compressive and tensile stresses at the interface between the diamond table and the substrate, and may cause the diamond table to delaminate from the substrate. At temperatures of about seven hundred fifty degrees Celsius (750° C.) and above, stresses within the diamond table may increase significantly due to differences in the coefficients of thermal expansion of the diamond material and the catalyst material within the diamond table itself. For example, cobalt thermally expands significantly faster than diamond, which may cause cracks to form and propagate within the diamond table, eventually leading to deterioration of the diamond table and ineffectiveness of the cutting element.

Furthermore, at temperatures at or above about seven hundred fifty degrees Celsius (750° C.), some of the diamond crystals within the diamond table may react with the catalyst material causing the diamond crystals to undergo a chemical breakdown or conversion to another allotrope of carbon. For example, the diamond crystals may graphitize in a reaction termed "back graphitization" at the diamond crystal boundaries, which may substantially weaken the diamond table. Also, at extremely high temperatures, in addition to graphite, some of the diamond crystals may be converted to carbon monoxide and carbon dioxide.

To reduce the problems associated with different rates of thermal expansion in polycrystalline diamond cutting elements, leaching processes are utilized to remove the catalyst material (e.g., cobalt) out from interstitial spaces between the diamond grains in the diamond table using, for example, an acid or combination of acids formulated specifically to remove certain phases of catalyst material from the diamond table. Nearly or substantially all of the catalyst material may be removed from the diamond table, or catalyst may be removed from only a portion of the diamond table. Thermally stable polycrystalline diamond tables in which substantially all catalyst material has been leached from the diamond table have been reported to be thermally stable up to temperatures of about one thousand two hundred degrees Celsius (1,200° C.). It has also been reported, however, that such fully leached diamond tables are relatively more brittle and vulnerable to shear, compressive, and tensile stresses than are non-leached, or partially leached, diamond tables. Therefore, selectively removing catalyst material from only a portion of the diamond table may have many advantages. For example, it is known to leach catalyst material from the cutting face, from the side of the diamond table (e.g., an "annulus leach"), or both, to a desired depth within the diamond table. Conventional leached diamond tables are known to contain between 1.5 wt %-2.5 wt % catalyst metal remaining in the leached portion of the diamond table subsequent to leaching.

BRIEF SUMMARY

Embodiments described herein include cutting elements, and related earth-boring tools, structures, supporting substrates, and methods of forming the cutting elements, structures, and supporting substrates. For example, in accordance with one embodiment described herein, a cutting element comprises a supporting substrate, and a cutting table attached to an end of the supporting substrate. The cutting table comprises a first region and a second region. The first region comprises inter-bonded diamond particles and is substantially free of at least highly catalytic metallic phases between the inter-bonded diamond particles, one or more non-catalytic compounds within interstitial spaces between the inter-bonded diamond particles, and voids within interstitial spaces between the inter-bonded diamond particles. The second region comprises inter-bonded diamond particles, the one or more non-catalytic compounds within interstitial spaces between the inter-bonded diamond particles, and one or more metallic phases within interstitial spaces between the inter-bonded diamond particles. The first region of the cutting table further comprises a content of elemental metal of at least about 2.6 wt %.

In additional embodiments, a method of forming a cutting element comprises providing a diamond-containing material over a substrate. Sintering the diamond-containing material in the presence of a homogenized binder to form a cutting table. During the sintering, converting portions of the homogenized binder within interstitial spaces between the inter-bonded diamond particles into one or more non-catalytic compounds and one or more metallic phases. Substantially removing an amount of at least highly catalytic metal phases of the one or more metallic phases from the cutting table to the a selected depth to form a first region of the cutting table comprising substantially only inter-bonded diamond particles, non-catalytic compounds and voids.

DETAILED DESCRIPTION

Figure 1:
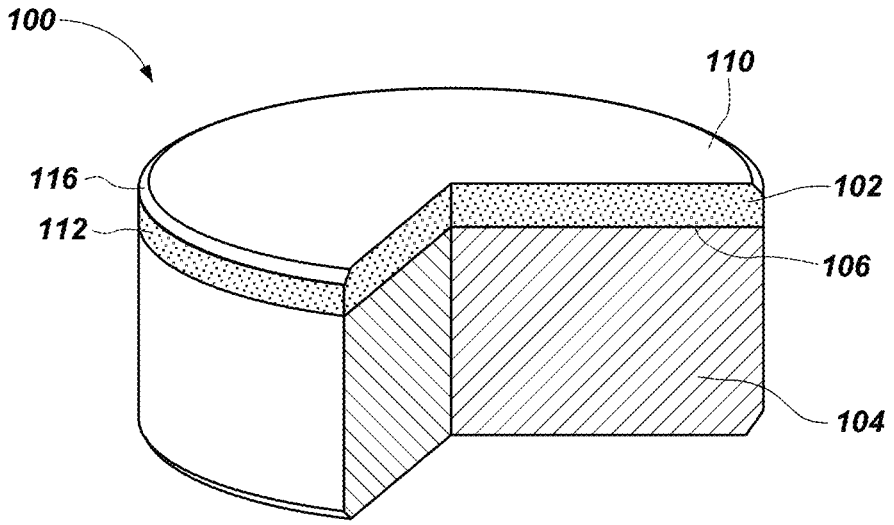
FIG. 1 is a partial cut-away perspective view of a cutting element of embodiments of the disclosure prior to further processing in accordance with the disclosure.

In an effort to provide cutting elements having diamond tables that are more thermally stable relative to cutting elements containing conventionally formed and partially leached diamond tables, cutting elements have been developed by the inventors herein that include an already thermally stable polycrystalline diamond table in which certain catalyst material phases have been selectively leached from a portion of the diamond table. The selectively leached diamond table may have greater amounts of metal remaining in the leached portion subsequent to leaching, which may result in cutting elements with not only enhanced thermal stability but also superior mechanical performance. The following description provides specific details, such as specific shapes, specific sizes, specific material compositions, and specific processing conditions, in order to provide a thorough description of embodiments of the present disclosure. However, a person of ordinary skill in the art would understand that the embodiments of the disclosure may be practiced without necessarily employing these specific details. Embodiments of the disclosure may be practiced in conjunction with conventional fabrication techniques employed in the industry. In addition, the description provided below does not form a complete process flow for manufacturing a cutting element or earth-boring tool. Only those process acts and structures necessary to understand the embodiments of the disclosure are described in detail below. Additional acts to form a complete cutting element or a complete earth-boring tool from the structures described herein may be performed by conventional fabrication processes.

Drawings presented herein are for illustrative purposes only, and are not meant to be actual views of any particular material, component, structure, device, or system. Variations from the shapes depicted in the drawings as a result, for example, of manufacturing techniques and/or tolerances, are to be expected. Thus, embodiments described herein are not to be construed as being limited to the particular shapes or regions as illustrated, but include deviations in shapes that result, for example, from manufacturing. For example, a region illustrated or described as box-shaped may have rough and/or nonlinear features, and a region illustrated or described as round may include some rough and/or linear features. Moreover, sharp angles that are illustrated may be rounded, and vice versa. Thus, the regions illustrated in the figures are schematic in nature, and their shapes are not intended to illustrate the precise shape of a region and do not limit the scope of the present claims. The drawings are not necessarily to scale. Additionally, elements common between figures may retain the same numerical designation.

As used herein, the terms "comprising," "including," "having," and grammatical equivalents thereof are inclusive or open-ended terms that do not exclude additional, unrecited elements or method steps, but also include the more restrictive terms "consisting of" and "consisting essentially of" and grammatical equivalents thereof. As used herein, the term "may" with respect to a material, structure, feature, or method act indicates that such is contemplated for use in implementation of an embodiment of the disclosure and such term is used in preference to the more restrictive term "is" so as to avoid any implication that other, compatible materials, structures, features, and methods usable in combination therewith should or must be excluded.

As used herein, the terms "longitudinal," "vertical," "lateral," and "horizontal" and are in reference to a major plane of a substrate (e.g., base material, base structure, base construction, etc.) in or on which one or more structures and/or features are formed and are not necessarily defined by earth's gravitational field. A "lateral" or "horizontal" direction is a direction that is substantially parallel to the major plane of the substrate, while a "longitudinal" or "vertical" direction is a direction that is substantially perpendicular to the major plane of the substrate. The major plane of the substrate is defined by a surface of the substrate having a relatively large area compared to other surfaces of the substrate.

As used herein, spatially relative terms, such as "below," "lower," "bottom," "above," "over," "upper," "top," and the like, may be used for ease of description to describe one element's or feature's relationship to another element(s) or feature(s) as illustrated in the figures. Unless otherwise specified, the spatially relative terms are intended to encompass different orientations of the materials in addition to the orientation depicted in the figures. For example, if materials in the figures are inverted, elements described as "over" or "above" or "on" or "on top of" other elements or features would then be oriented "below" or "beneath" or "under" or "on bottom of" the other elements or features. Thus, the term "over" can encompass both an orientation of above and below, depending on the context in which the term is used, which will be evident to one of ordinary skill in the art. The materials may be otherwise oriented (e.g., rotated 90 degrees, inverted, flipped) and the spatially relative descriptors used herein interpreted accordingly.

As used herein, the singular forms "a," "an," and "the" are intended to include the plural forms as well, unless the context clearly indicates otherwise.

As used herein, the term "and/or" includes any and all combinations of one or more of the associated listed items.

As used herein, the term "configured" refers to a size, shape, material composition, material distribution, orientation, and arrangement of one or more of at least one structure and at least one apparatus facilitating operation of one or more of the structure and the apparatus in a predetermined way.

As used herein, the term "substantially" in reference to a given parameter, property, or condition means and includes to a degree that one of ordinary skill in the art would understand that the given parameter, property, or condition is met with a degree of variance, such as within acceptable tolerances. By way of example, depending on the particular parameter, property, or condition that is substantially met, the parameter, property, or condition may be at least 90.0 percent met, at least 95.0 percent met, at least 99.0 percent met, or even 100.0 percent met.

As used herein, "about" or "approximately" in reference to a numerical value for a particular parameter is inclusive of the numerical value and a degree of variance from the numerical value that one of ordinary skill in the art would understand is within acceptable tolerances for the particular parameter. For example, "about" or "approximately" in reference to a numerical value may include additional numerical values within a range of from 90.0 percent to 110.0 percent of the numerical value, such as within a range of from 95.0 percent to 105.0 percent of the numerical value, within a range of from 97.5 percent to 102.5 percent of the numerical value, within a range of from 99.0 percent to 101.0 percent of the numerical value, within a range of from 99.5 percent to 100.5 percent of the numerical value, or within a range of from 99.9 percent to 100.1 percent of the numerical value.

As used herein, the terms "earth-boring tool" and "earth-boring drill bit" each mean and include any type of bit or tool used for drilling during the formation or enlargement of a wellbore in a subterranean formation and include, for example, fixed-cutter bits, roller cone bits, percussion bits, core bits, eccentric bits, bi-center bits, reamers, mills, drag bits, hybrid bits (e.g., rolling components in combination with fixed cutting elements), and other drilling bits and tools known in the art.

As used herein, the term "cutting elements" means and includes, for example, superabrasive (e.g., polycrystalline diamond compact or "PDC") cutting elements employed as fixed cutting elements, as well as superabrasive inserts comprising a PDC layer over a supporting substrate mounted to a body of an earth-boring tool.

As used herein, the term "inter-granular bond" means and includes any direct atomic bond (e.g., covalent, ionic, etc.) between atoms in adjacent particles of hard material.

As used herein, the term "void" means and includes a space in a polycrystalline material that remains unoccupied and is essentially free of any material.

A cutting element (e.g., a polycrystalline diamond compact cutting element) including a selectively leached region of the diamond table is disclosed. The cutting element is produced by forming a thermally stable cutting element with metallic phases and non-catalytic compounds within interstitial spaces between inter-bonded diamond particles, a portion of the thermally stable cutting element subjected to a process, for example leaching, to remove at least some metallic phases, for example highly catalytic metallic phases. A leach depth may be measured from a cutting face of a cutting table of the cutting element, a side of the cutting table, or both, and selected to further enhance at least one of thermal stability and toughness (e.g., impact resistance) of the cutting table. The cutting element including a selectively leached region may exhibit both improved thermal and mechanical performance compared to a conventional cutting element.

To form a selectively leached thermally stable cutting element according to the disclosure, a thermally stable cutting element may be formed initially in accordance with U.S. Application Ser. No. 15/993,362, and titled "Cutting Elements and Earth-Boring Tools, Supporting Substrates, and Methods," the contents of which are hereby incorporated herein by this reference and a portion of which is represented in FIGS. 1 and 2 of the present disclosure.

The cutting element 100 of FIG. 1 includes a supporting substrate 104, and a cutting table 102 bonded to the supporting substrate 104 at an interface 106. The cutting table 102 may be disposed directly on the supporting substrate 104. The cutting table 102 may exhibit at least one lateral side surface 112 (also referred to as the "barrel" of the cutting table 102), a cutting face 110 (also referred to as the "top" of the cutting table 102) opposite the interface 106, and at least one cutting edge 116 at a periphery (e.g., outermost boundary) of the cutting face 110. As shown, cutting edge 116 may be chamfered to mitigate any tendency toward chipping before the cutting element 100 becomes minimally worn.

Figure 2:
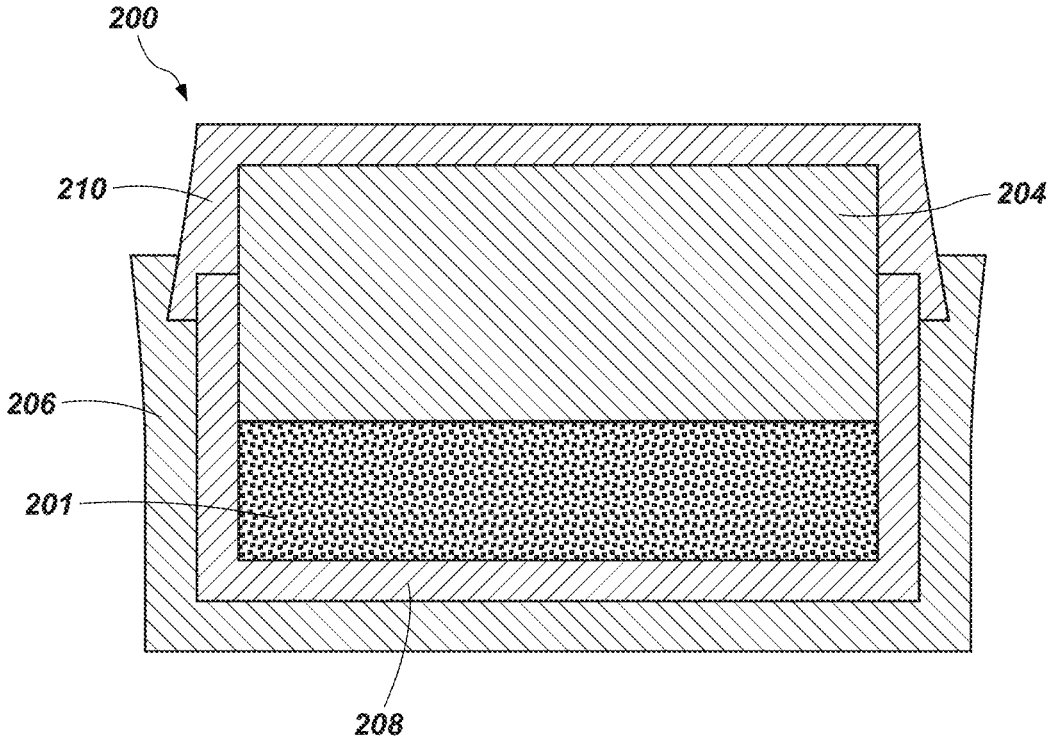
FIG. 2 is a simplified cross-sectional view of a container in a process of forming a cutting element of FIG. 1.

FIG. 2 shows a simplified cross-sectional view of a container 200 in a method for forming a thermally stable cutting element 100 as shown in FIG. 1. A particulate, diamond-containing material 201 may be provided within the container 200, and a supporting substrate 204 may be provided directly on the diamond-containing material 201. The container 200 may substantially surround and hold the diamond-containing material 201 and the supporting substrate 204. As shown in FIG. 2, the container 200 may include an inner cup 208 in which the diamond-containing material 201 and a portion of the supporting substrate 204 may be disposed, a bottom end piece 206 in which the inner cup 208 may be at least partially disposed, and a top end piece 210 surrounding the supporting substrate 204 and coupled (e.g., swage bonded) to one or more of the inner cup 208 and the bottom end piece 206. In additional embodiments, the bottom end piece 206 may be omitted (e.g., absent).

The diamond-containing material 201 and the supporting substrate 204 may be subjected to HTHP processing to form the cutting table 102. The cutting table 102 may be formed by sintering the diamond-containing material 201 with a homogenized binder present in supporting substrate 204 and converting portions of the binder into non-catalytic compounds and metallic phases between diamond particles of the inter-bonded diamond particles.

The diamond-containing material 201 (e.g., diamond powder) may be formed of and include discrete diamond particles (e.g., discrete natural diamond particles, discrete synthetic diamond particles, combinations thereof, etc.). The discrete diamond particles may individually exhibit a desired particle size. The discrete diamond particles may comprise, for example, one or more of micro-sized diamond particles and nano-sized diamond particles. In addition, each of the discrete diamond particles may individually exhibit a desired shape, such as at least one of a spherical shape, a hexahedral shape, an ellipsoidal shape, a cylindrical shape, a conical shape, or an irregular shape. Each of the discrete diamond particles of the diamond-containing material 201 exhibits a substantially spherical shape. The discrete diamond particles may be monodisperse, wherein each of the discrete diamond particles exhibits substantially the same material composition, size, and shape, or may be polydisperse, wherein at least one of the discrete diamond particles exhibits one or more of a different material composition, a different particle size, and a different shape than at least one other of the discrete diamond particles. The diamond-containing material 201 may be formed by conventional processes, which are not described herein.

In some embodiments, the diamond-containing material 201 may be formed of and include diamond-containing agglomerates as described in U.S. Patent Publication No. US2021/0245244A1 (to Robertson), the contents of which are hereby incorporated herein by this reference. Precursor diamond-containing agglomerates may include discrete diamond particles intermixed with a binder material and/or a wax material (e.g., paraffin wax or polyethylene glycol (PEG)). The precursor diamond-containing agglomerates may be sintered while exposing the precursor diamond-containing agglomerates to a quantity of catalyst material to form diamond-containing agglomerates. The diamond-containing agglomerates may include discrete quantities of polycrystalline and/or superabrasive material while inhibiting formation of inter-granular bonds among the agglomerates themselves. In some embodiments, the diamond-containing agglomerates may contain include catalytic, non-advantageous metallic compounds or metallic phases (e.g., catalytic cobalt, catalytic iron, catalytic nickel). For example, the non-advantageous metallic compounds or metallic phases may not be leached from the diamond-containing agglomerates (e.g., "non-leached" diamond-containing agglomerates). In additional embodiments, the diamond-containing agglomerates may be at least substantially free of the non-advantageous metallic compounds or metallic phases. For example, the non-advantageous metallic compounds or metallic phases may be leached from the diamond-containing agglomerates (e.g., "leached" diamond-containing agglomerates).

The supporting substrate 204 may include a consolidated structure including tungsten carbide (WC) particles dispersed within a homogenized binder (e.g., a substantially homogeneous alloy, such as a substantially homogeneous peritectic alloy) including at least one first element selected from Sc, Ti, V, Cr, Mn, Fe, Co, Ni, Cu, Zn, Y, Zr, Nb, Mo, Tc, Ru, Rh, Pd, Ag, Cd, Hf, Ta, Re, Os, Ir, Pt, Au, Hg, La, Ce, Pr, Nd, Pm, Sm, Eu, Gd, Tb, Dy, Ho, Er, Tm, Yb, Lu, Ac, Th, Pa, and U and at least one second element selected from Al, Ga, Sn, Be, Bi, Te, Sb, Se, As, Ge, Si, B, and P; C; and W. The homogenized binder may, for example, include from about 35 weight percent (wt %) to about 95 wt % of the first element; from about 2.0 wt % to about 60 wt % of the second element; from about 0.1 wt % C to about 10 wt % C; and a remainder of W. The supporting substrate 204 may include from about 80 wt % to about 95 wt % of the WC particles, and from about 5 wt % to about 20 wt % of the homogenized binder. As noted above, homogenized binder of the supporting substrate 204 may be employed to convert the discrete diamond particles and/or the diamond-containing agglomerates of the diamond-containing material 201 into inter-bonded diamond particles.

Each of the discrete WC particles may individually exhibit a desired particle size, such as a particle size less than or equal to about 1000 μm. The discrete WC particles may include, for example, one or more of discrete micro-sized WC particles and discrete nano-sized WC particles. In addition, each of the discrete WC particles may individually exhibit a desired shape, such as one or more of a spherical shape, a hexahedral shape, an ellipsoidal shape, a cylindrical shape, a conical shape, or an irregular shape.

The discrete WC particles of the WC powder may be monodisperse, wherein each of the discrete WC particles exhibits substantially the same size and shape, or may be polydisperse, wherein at least one of the discrete WC particles exhibits one or more of a different particle size and a different shape than at least one other of the discrete WC particles. The WC powder has a multi-modal (e.g., bi-modal, tri-modal, etc.) particle size distribution. For example, the WC powder may include a combination of relatively larger, discrete WC particles and relatively smaller, discrete WC particles. The WC powder has a mono-modal particle size distribution. For example, all of the discrete WC particles of the WC powder may exhibit substantially the same particle size. The discrete WC particles may be formed by conventional processes, which are not described herein.

The HTHP processing may include subjecting the diamond-containing material 201 and the supporting substrate 204 including WC particles dispersed within the homogenized binder to elevated temperatures and elevated pressures in a directly pressurized and/or indirectly heated cell for a sufficient time to convert the discrete diamond particles and/or the diamond-containing agglomerates of the diamond-containing material 201 into inter-bonded diamond particles. The temperatures (e.g., sintering temperature(s)) employed within the heated, pressurized cell may be greater than the solidus temperature (e.g., greater than the solidus temperature and less than or equal to the liquidus temperature, greater than or equal to the liquidus temperature, etc.) of the homogenized binder of the supporting substrate 204, and pressures within the heated, pressurized cell may be greater than or equal to about 2.0 GPa (e.g., greater than or equal to about 3.0 GPa, such as greater than or equal to about 4.0 GPa, greater than or equal to about 5.0 GPa, greater than or equal to about 6.0 GPa, greater than or equal to about 7.0 GPa, greater than or equal to about 8.0 GPa, or greater than or equal to about 9.0 GPa). The temperature(s) employed during the HTHP processing to form the cutting table 102 at least partially depend on the pressure(s) employed during the HTHP processing, and on the material composition of the homogenized binder of the supporting substrate 204. The diamond-containing material 201 and the supporting substrate 204 may be held at selected temperatures and pressures within the heated, pressurized cell for a sufficient amount of time to facilitate the inter-bonding of the discrete diamond particles and/or the diamond agglomerates of the diamond-containing material 201, such as a period of time between about 30 seconds and about 20 minutes.

During the HTHP processing, the homogenized binder of the supporting substrate 204 melts and a portion thereof is swept (e.g., mass transported, diffused) into the diamond-containing material 201 (FIG. 2). The homogenized binder received by the diamond-containing material 201 catalyzes the formation of inter-granular bonds between the discrete diamond particles and/or the diamond agglomerates of the diamond-containing material 201 to form inter-bonded diamond particles, the non-catalytic compounds (e.g., perovskite compounds) within interstitial spaces between the inter-bonded diamond particles, and residual Group VIII catalyst materials including highly catalytic metal phases (e.g., catalytic cobalt, catalytic iron, catalytic nickel) within interstitial spaces between the inter-bonded diamond particles. The inter-bonded diamond particles may have a multi-modal particle size distribution. For example, the cutting table 102 may include relatively larger diamond particles (e.g., larger diamond particles) and relatively smaller diamond particles (e.g., smaller diamond particles). The inter-bonded diamond particles may have a mono-modal particle size distribution (e.g., the smaller diamond particles may be omitted, or the larger diamond particles may be omitted). The cutting table may include direct inter-granular bonds between the larger diamond particles and the smaller diamond particles. The larger diamond particles may be monodisperse, wherein all the larger diamond particles exhibit substantially the same size, or may be polydisperse, wherein the larger diamond particles exhibit a range of sizes and are averaged. In addition, the smaller diamond particles may be monodisperse, wherein all the smaller diamond particles exhibit substantially the same size, or may be polydisperse, wherein the smaller diamond particles exhibit a range of sizes and are averaged.

Following formation of the cutting element, such as the thermally stable cutting element 100 of FIG. 1, the cutting element may be subjected to selective removal (e.g. selective leaching) of catalytic, non-advantageous metallic compounds or metallic phases. For example, a leaching agent may be introduced to the cutting table 102 of FIG. 1, the formulation of the leaching agent may be tailored to remove the metallic phases, while non-catalytic compounds may remain within interstitial spaces between inter-bonded diamond particles. As non-limiting examples, non-catalytic compounds may comprise copper and/or lead.

A highly oxidizing leaching agent may be utilized to at least substantially remove metallic phases from the cutting table. Specifically, aqua regia (a mixture of concentrated nitric acid ($HNO_3$) and concentrated hydrochloric acid (HCl)) may be used as a leaching agent. For example, the leaching agent composition may comprise various volumetric ratios of HCL and $HNO_3$. As non-limiting examples, the leaching agent composition may include volumetric ratios ranging from 1 part by volume HCl, and 3 parts by volume $HNO_3$, to 3 parts by volume HCl, and 1 part by volume $HNO_3$. In addition to $HNO_3$ and HCl, the leaching agent may include compositions (e.g., mixtures) of sulfuric acid ($H_2SO_4$), hydrogen peroxide ($H_2O_2$), and/or perchlorate ($HClO_4$) may also be used. For example, the leaching agent composition may comprise various volumetric ratios of $H_2SO_4$ and $H_2O_2$. As non-limiting examples, the leaching agent composition may include volumetric ratios ranging from 3 parts by volume $H_2SO_4$, and 1 part by volume $H_2O_2$, to 7 parts by volume $H_2SO_4$, and 1 part by volume $H_2O_2$. The acids (e.g., HCl and $HNO_3$) may be reagent grade in purity and concentration. Additionally, the temperature of the leaching agent composition may be from about 150° F. to about 200° F. (e.g., about 180° F.). By adjusting one or more of the temperature, leach chemistries, or process time, the catalytic, non-advantageous metallic phases may be targeted and removed (e.g. leached) from the cutting table. As non-limiting examples, the leaching process may occur at temperatures of from about 60° C. to about 80° C. Additionally, the duration of the leaching process may be from about 168 hours to about 1008 hours (e.g., about 1 to about 6 weeks), which may at least partially depend on the temperature during the leaching process. In some embodiments, a current may be applied to the leaching agent to provide an "electrolytic boost" and facilitate the leaching process.

Figure 3A:
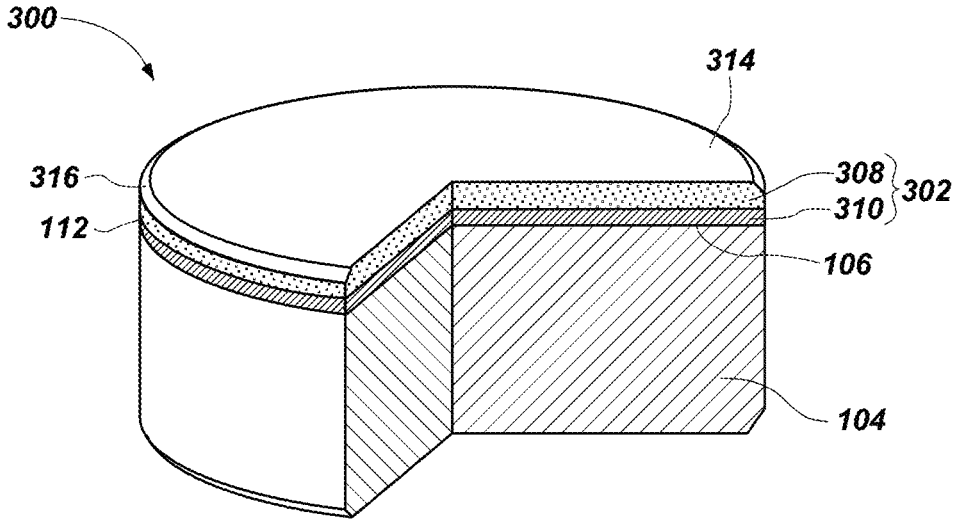
FIG. 3A is a partial cut-away perspective view of the cutting element of FIG. 1, in accordance with embodiments of the disclosure after further processing.
Figure 3B:
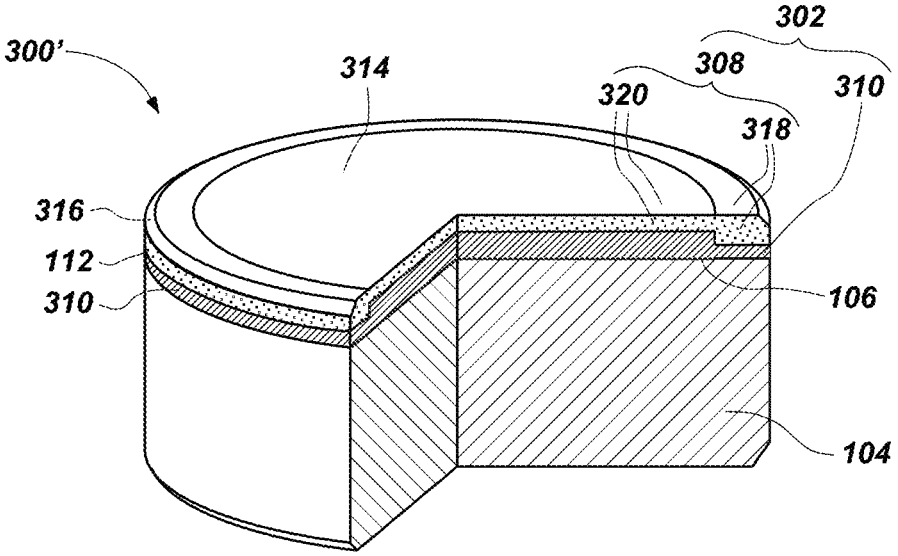
FIG. 3B is a partial cut-away perspective view of the cutting element of FIG. 1, in accordance with additional embodiments of the disclosure after further processing.

Referring collectively to FIGS. 3A and 3B, a depth of penetration of the leaching agent (e.g., leach depth) may be selected to control one or more physical properties, such as, but not limited to, thermal stability and toughness. The selective leaching of cutting element 100 (FIG. 1) is used to form embodiments of a cutting element 300, 300' including a first region 308 and a second region 310 of the cutting table 302. The leach depth corresponds to a first region 308 of a cutting table 302 shown in FIGS. 3A and 3B. The cutting element 300, 300' includes a supporting substrate 104, and a cutting table 302 bonded to the supporting substrate 104 at an interface 106. The cutting table 302 may exhibit at least one lateral side surface 112 (also referred to as the "barrel" of the cutting table 302), a cutting face 114 (also referred to as the "top" of the cutting table 302) opposite the interface 106, and cutting edge 316 at a periphery (e.g., outermost boundary) of the cutting face 314. The interface 106 located between the supporting substrate 104 and the cutting table 302. The first region 308 of the cutting table 302 includes the cutting face 314 and the cutting edge 316. The second region 310 of the cutting table 302 opposite the supporting substrate 104 between the interface 106 and the first region 308.

The cutting table 302 and the supporting substrate 104 may each individually exhibit a generally cylindrical column shape, and the interface 106 between the supporting substrate 104 and cutting table 302 may be substantially planar, although use of a non-planar interface is also contemplated. A height (e.g., thickness) of the cutting table 302 may be within a range of from about 0.3 millimeters (mm) to about 5 mm.

Referring now to the embodiment of the cutting element 300 of FIG. 3A, the first region 308 of the cutting table 302 is formed by selectively removing (e.g. leaching) metallic phases 424 from a region of cutting table 102 starting at the cutting face 110 to the pre-determined leach depth in the direction of the interface 106. The leach depth corresponds to the thickness of the first region 308. The thickness of the first region 308 of the cutting table 302 is measured from the cutting face 314 to a boundary with the second region 310 of the cutting table 302. The leach depth (e.g., the thickness of the first region 308) may extend from the cutting face 314 toward the supporting substrate 104 and may be within from about 750 μm to about 1000 μm of the interface 106 between the supporting substrate 104 and the cutting table 302. In some embodiments, the thickness of the first region 308 (e.g., the leach depth) may be from about 10 μm to about 1500 μm (about 1.5 mm), from about 20 μm to about 1200 μm (about 1.2 mm), from about 30 μm to about 1000 μm (about 1 mm), from about 40 μm to about 500 μm, from about 50 μm to about 250 μm, such as from about 50 μm to about 100 μm, or from about 100 μm to about 250 μm. In additional embodiments, the thickness of the first region 308 (e.g., the leach depth) may be from about 50 μm to about 1500 μm.

Referring now to the embodiment of the cutting element 300' of FIG. 3B, the side surface 112 of cutting table 302 may also undergo leaching. For example, the cutting table 302 may include a leached portion 318 extending around the cutting edge 316 of the cutting face 314 and toward the supporting substrate 104 through a portion of the volume of the cutting table 302 proximate the side surface 112 of the cutting table 302. Such a portion may be referred to as a "barrel leach" or "annulus leach." Accordingly, the first region 308 of the cutting table 102 may include a first leach depth within an interior (e.g., central) portion 320 of the first region 308, and a second leach depth within an exterior (e.g., annular) portion 318 of the first region 308. The leach depth from the side surface 112 (e.g., the "barrel leach") may extend toward the supporting substrate 104 and may be within from about 750 μm to about 1000 μm of the interface 106 between the supporting substrate 104 and the cutting table 302. Thus, the "barrel leach" depth may vary with the thickness of the cutting table 102. For example, the "barrel leach" may include a leach depth from the side surface 112 from about 10 μm to about 4000 μm (about 4 mm), from about 20 μm to about 2000 μm (about 2 mm), from about 30 μm to about 1000 μm (about 1 mm), from about 40 μm to about 500 μm, from about 50 μm to about 250 μm, such as from about 50 μm to about 100 μm, or from about 100 μm to about 250 μm. In some embodiments, the "barrel leach" depth may be from about 1000 μm (about 1 mm) to about 4000 μm (about 4 mm).

Referring again collectively to FIGS. 3A and 3B, the cutting element 300, 300' may exhibit improved thermal and mechanical performance in comparison to non-leached thermally stable cutting elements 100 and are substantially superior to partially leached conventional cutting elements. The content of metal elements of the first region 308 of the cutting table 302 after leaching may be within the range of from about 2.6 wt % (weight percent) to about 6 wt %, such as from about 2.6 wt % to about 3 wt %, or from about 3 wt % to about 6 wt %, greater than the elemental metal content of the leached region of a conventional leached cutting element.

Figure 4A:
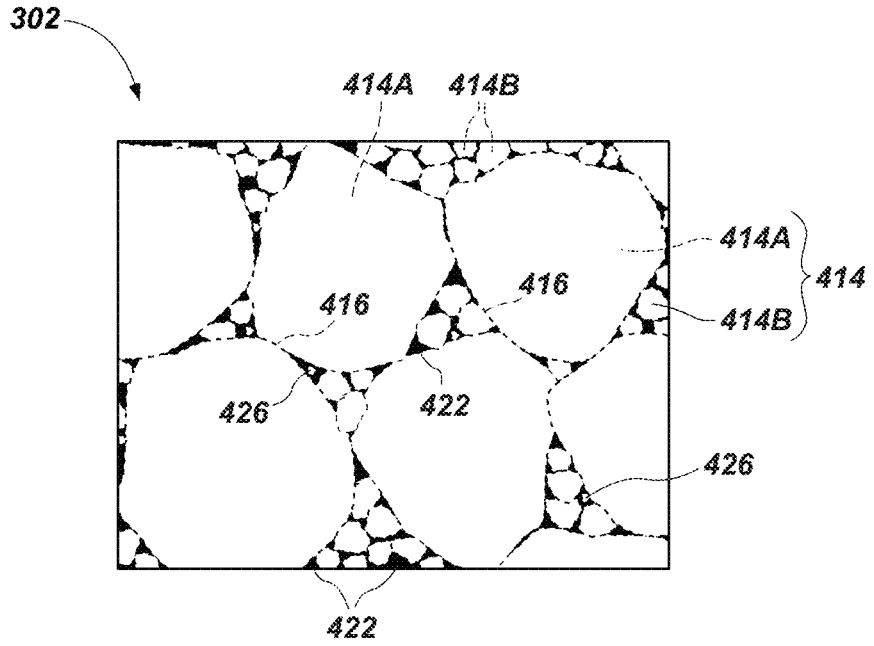
FIG. 4A is a simplified cross-sectional view showing how a microstructure of a selectively leached cutting table (first region) of the cutting element of FIG. 3 may appear under magnification, in accordance with embodiments of the disclosure.
Figure 4B:
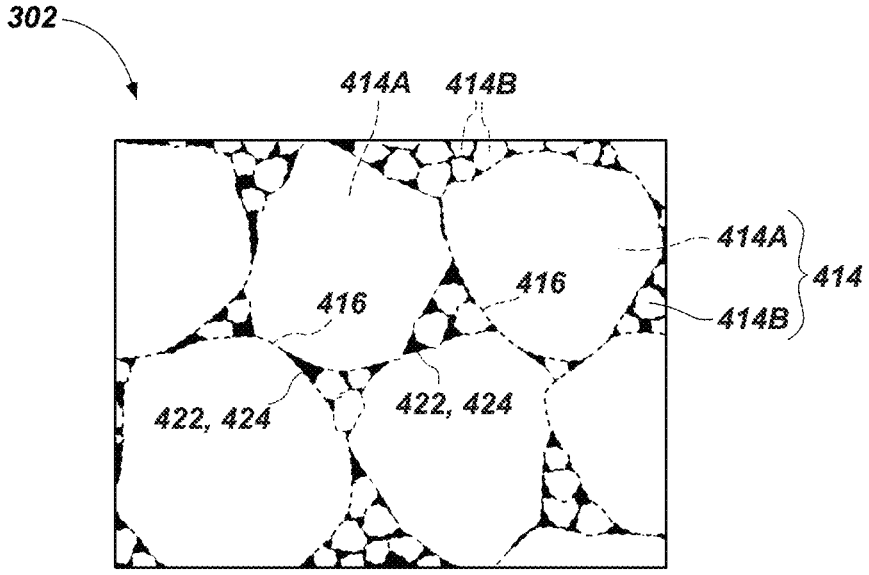
FIG. 4B is a simplified cross-sectional view showing how a microstructure of a selectively leached cutting table (second region) of the cutting element of FIG. 3 may appear under magnification, in accordance with embodiments of the disclosure.

FIG. 4A is a simplified cross-sectional view showing how a microstructure of the first region 308 of cutting table 302 shown in FIG. 3 may appear under magnification. FIG. 4B is a simplified cross-sectional view showing how a microstructure of the second region 310 of cutting table 302 shown in FIG. 3 may appear under magnification. Referring to FIGS. 4A and 4B together, the first region 308 and second region 310 of the cutting table 302 includes interspersed and inter-bonded diamond particles 414 (e.g., inter-bonded diamond particles) that form a three-dimensional (3D) network of polycrystalline diamond (PCD) material. The inter-bonded diamond particles 414 may have a multi-modal particle size distribution. For example, as depicted in FIGS. 4A and 4B, the first region 308 and the second region 310 of the cutting table 302 may include relatively larger diamond particles 414A (e.g., larger diamond particles) and relatively smaller diamond particles 414B (e.g., smaller diamond particles). In additional embodiments, the inter-bonded diamond particles 414 may have a mono-modal particle size distribution (e.g., the smaller diamond particles 414B may be omitted, or the larger diamond particles 414A may be omitted). Direct inter-granular bonds between the larger diamond particles 414A and the smaller diamond particles 414B are represented in FIGS. 4A and 4B by dashed lines 416. The larger diamond particles 414A may be monodisperse, wherein all the larger diamond particles 414A exhibit substantially the same size, or may be polydisperse, wherein the larger diamond particles 414A exhibit a range of sizes and are averaged. In addition, the smaller diamond particles 414B may be monodisperse, wherein all the smaller diamond particles 414B exhibit substantially the same size, or may be polydisperse, wherein the smaller diamond particles 414B exhibit a range of sizes and are averaged.

As shown in FIG. 4A, interstitial spaces are present between the inter-bonded diamond particles 414 of the first region 308 of the cutting table 302. Voids 426 are present in the first region 308 of the cutting table 302 in locations where the metallic phases 424, shown in FIG. 4B, previously occupied. The interstitial spaces of the cutting table 302 are at least partially (e.g., substantially) filled with a non-catalytic compound 422 and voids 426. The first region 308 is substantially free of at least highly catalytic metallic phases 424. For example, 0.5 wt % or less of the highly catalytic metallic phases may remain in the first region 308. The second region 310 of the cutting table 302 has not been subjected to the selective removal of the metallic phases 424 from cutting table 302, leaving the second region 310 containing metallic phases 424 as shown in FIG. 4B and substantially free of voids 426. As shown in FIG. 4B, the interstitial spaces are at least partially (e.g., substantially) filled with non-catalytic compounds 422 and metallic phases 424. The non-catalytic compounds 422 of the second region 310 of the cutting table 302 may be a perovskite compound having the same general chemical formula shown above with reference to the non-catalytic compound 422 of the first region 308 of the cutting table 302.

The non-catalytic compound 422 of the first region 308 and the second region 310 of the cutting table 302 may be a perovskite compound having the general chemical formula shown below:

$$A_3XZ_{1-d} \quad (1)$$

In equation (1) above, d may be greater than or equal to 0 and less than or equal to 0.5. In other words, $0 \leq d \leq 0.5$. A comprises one or more of scandium (Sc), titanium (Ti), vanadium (V), chromium (Cr), manganese (Mn), iron (Fe), nickel (Ni), copper (Cu), zinc (Zn), yttrium (Y), zirconium (Zr), niobium (Nb), molybdenum (Mo), technetium (Tc), ruthenium (Ru), rhodium (Rh), palladium (Pd), silver (Ag), cadmium (Cd), hafnium (Hf), tantalum (Ta), tungsten (W), rhenium (Re), osmium (Os), iridium (Ir), platinum (Pt), gold (Au), mercury (Hg), lanthanum (La), cerium (Ce), praseodymium (Pr), neodymium (Nd), promethium (Pm), samarium (Sm), europium (Eu), galodinium (Gd), terbium (Tb), dysprosium (Dy), holmium (Ho), erbium (Er), thulium (Tm), ytterbium (Yb), lutetium (Lu), actinium (Ac), thorium (Th), protoactinium (Pa), and uranium (U); X comprises one or more of aluminum (Al), gallium (Ga), tin (Sn), beryllium (Be), bismuth (Bi), tellurium (Te), antimony (Sb), selenium (Se), arsenic (As), germanium (Ge), silicon (Si), boron (B), and phosphorus (P); and Z is carbon (C). The non-catalytic compounds 422 include at least three different elements.

The presence of the non-catalytic compound 422 in combination with the absence of at least the highly catalytic metallic phases 424 in the first region 308 may render the first region 308 of the cutting table 302 more thermally stable than thermally stable cutting element 100 of FIG. 1 before leaching due to the absence of at least highly catalytic metallic phases 424 in the first region 308 of the cutting table as well as more thermally stable than conventional partially leached cutting tables. For example, the non-catalytic compounds 422 may not significantly promote carbon transformations (e.g., graphite-to-diamond or vice versa) as compared to conventional leached cutting tables including inter-bonded diamond particles and residual Group VIII catalyst materials (e.g., catalytic cobalt, catalytic iron, catalytic nickel) within interstitial spaces between the inter-bonded diamond particles.

Each of the surfaces of the cutting table 302 may be polished, or one or more of the surfaces of the cutting table 302 may be at least partially non-polished (e.g., lapped, but not polished). In addition, the cutting edge 316 of the cutting table 302 may be at least partially (e.g., substantially) chamfered (e.g., beveled), may be at least partially (e.g., substantially) radiused (e.g., arcuate), may be partially chamfered and partially radiused, or may be non-chamfered and non-radiused. As shown in FIG. 3, in some embodiments, the cutting edge 316 is chamfered. If the cutting edge 316 is at least partially chamfered, the cutting edge 316 may include a single (e.g., only one) chamfer, or may include multiple (e.g., more than one) chamfers (e.g., greater than or equal to two (2) chamfers, such as from two (2) chamfers to 1000 chamfers). If present, each of the chamfers may individually exhibit a width less than or equal to about 0.1 inch, such as within a range of from about 0.001 inch to about 0.1 inch.

Figure 5:
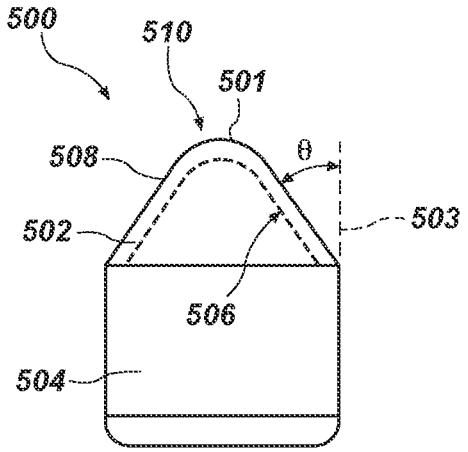
FIG. 5 is a side elevation view of a cutting element, in accordance with embodiments of the disclosure.

FIG. 5 shows a simplified side elevation view of a cutting element 500 in the form of an insert for a roller cone drill bit, in accordance with another embodiment of the disclosure. While FIGS. 3A and 3B depict particular configurations of the cutting element 300, 300' including particular configurations of the cutting table 302 and the supporting substrate 104 thereof, different configurations may be employed. The cutting table 302 and/or the supporting substrate 104 may exhibit any desired shape. For example, the cutting table 302 and/or the supporting substrate 104 may exhibit a one or more shapes (e.g., a dome shape, a conical shape, a frusto conical shape, a rectangular column shape, a pyramidal shape, a frusto pyramidal shape, a fin shape, a pillar shape, a stud shape, or an irregular shape), one or more sizes (e.g., diameter, height), and/or the interface 106 between the supporting substrate 104 and cutting table 302 may be non-planar (e.g., convex, concave, ridged, sinusoidal, angled, jagged, v-shaped, u-shaped, irregularly shaped, etc.). In some embodiments, the cutting table 302 may exhibit substantially the same shape and/or size (e.g., dimensions) as the supporting substrate 104. In additional embodiments, the cutting table 302 may exhibit a different shape and/or size than the supporting substrate 104. As specific, non-limiting examples, the cutting element 300, 300' may exhibit a shape similar to that described in any of U.S. Pat. No. 10,954,721 B2 to Russell et al. (Mar. 23, 2021), U.S. Pat. No. 10,590,710 B2 to Vempati et al. (Mar. 17, 2020), U.S. Pat. No. 10,465,447 B2 to Stockey et al. (Nov. 5, 2019), U.S. Pat. No. 9,845,642 B2 to Stockey (Dec. 19, 2017), U.S. Pat. No. 8,887,838 B2 to Stowe, II (Nov. 18, 2014), and U.S. Pat. No. 8,061,456 B2 to Patel et al. (Nov. 22, 2011), the contents of each of which are incorporated herein by this reference.

The cutting element 500 includes a supporting substrate 504, and a cutting table 502 bonded to the supporting substrate 504 at an interface 506. The cutting table 502 may have a material composition and a material distribution substantially similar to the material composition and the material distribution of the cutting table 302 previously described with reference to FIGS. 3-4B. In other words, a first, outer region of the cutting table 502 may be substantially devoid of at least highly catalytic metallic phases, while a second, inner region of cutting table 502 adjacent supporting substrate 504 may retain the material composition of the cutting table 502 as formed and before further processing. In addition, the supporting substrate 504 may have a material composition and a material distribution substantially similar to the material composition and the material distribution of one or more of the supporting substrates 104 previously described with reference to FIGS. 1-3. As shown in FIG. 5, the cutting table 502 exhibits a generally conical shape, and includes a conical side surface 508 and an apex 501 (e.g., tip) that at least partially define a cutting face 510 of the cutting table 502. The apex 501 comprises an end of the cutting table 502 opposing another end of the cutting table 502 secured to the supporting substrate 504 at the interface 506. The conical side surface 508 extends upwardly and inwardly from or proximate the interface 506 toward the apex 501. The apex 501 may be centered about a central longitudinal axis of the cutting element 500, and may be at least partially (e.g., substantially) radiused (e.g., arcuate). The conical side surface 508 may be defined by at least one angle θ between the conical side surface 508 and a phantom line 503 (shown in FIG. 5 with dashed lines) longitudinally extending from a lateral side surface of the supporting substrate 504. The angle θ may, for example, be within a range of from about five degrees (5°) to about eighty-five degrees (85°), such as from about fifteen degrees (15°) to about seventy-five degrees (75°), from about thirty degrees (30°) to about sixty degrees (60°) or from about forty-five degrees (45°) to about sixty degrees (60°).

Figure 6:
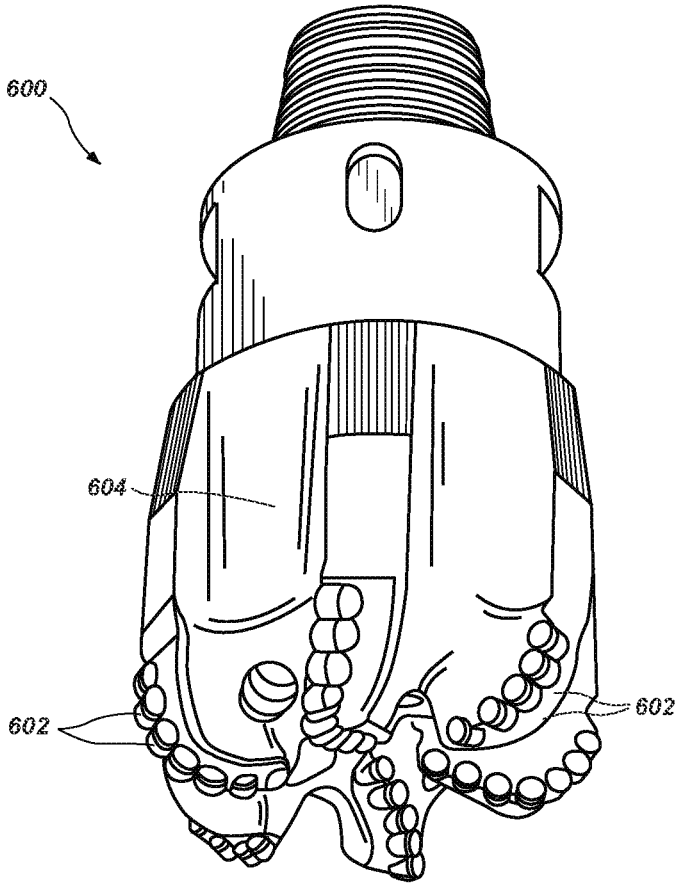
FIG. 6 is a perspective view of an embodiment of a fixed-cutter earth-boring rotary drill bit including a cutting element of the disclosure.

Embodiments of cutting elements (e.g., cutting elements 300, 300' and 500, shown in FIG. 3A, FIG. 3B, and FIG. 5, respectively) described herein may be secured to an earth-boring tool and used to remove subterranean formation material in accordance with additional embodiments of the disclosure. The earth-boring tool may, for example, be a rotary drill bit, a percussion bit, a coring bit, an eccentric bit, a reamer tool, a milling tool, etc. As a non-limiting example, FIG. 6 shows a fixed-cutter type earth-boring rotary drill bit 600 that includes cutting elements 602. One or more of the cutting elements 602 may be substantially similar to cutting element 300, 300' previously described herein with respect to FIGS. 3-4B, and may be formed in accordance to the processes previously described herein with reference to FIG. 2. The rotary drill bit 600 includes a bit body 604, and the cutting elements 602 are attached to the bit body 604. The cutting elements 602 may be, for example, brazed, welded, or otherwise secured, within pockets formed in an outer surface of the bit body 604.

Figure 7A:
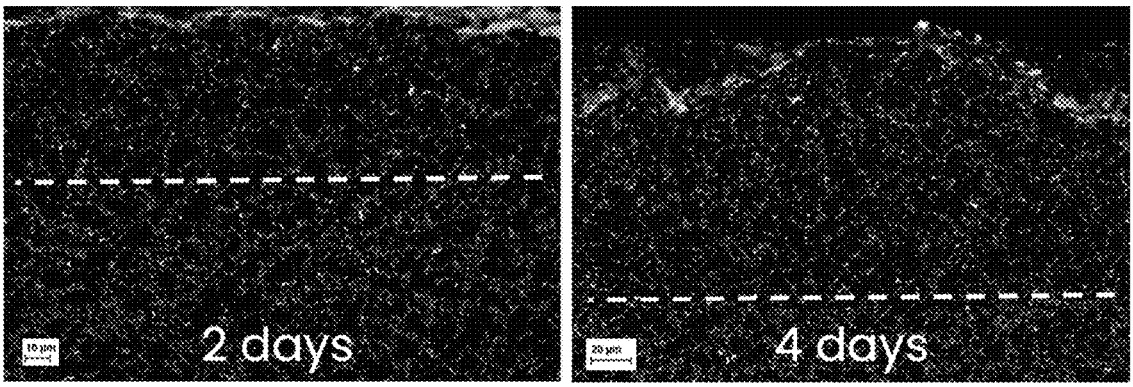
FIG. 7A is a series of photomicrographs showing the microstructural comparison of different leach durations of a cutting table of a selectively leached cutting element.

An example of a cross-sectional view of the first region 308 (e.g., a leached layer) in accordance with embodiments of the disclosure are shown in the micrographs in FIG. 7A. The image on the left shows an example of the leached layer after an exposure to a leaching agent for a duration of 2-days. The image on the right shows an example of a leached layer after an exposure to a leaching agent for a duration of 4-days. In both the left and right images, the dotted line highlights the depth of penetration of the leaching agent, or the thickness of the first region 308 of the cutting table 302. The dotted line also corresponds to the region of the cutting table above which metallic phases 424 have been selectively removed.

Figure 7B:
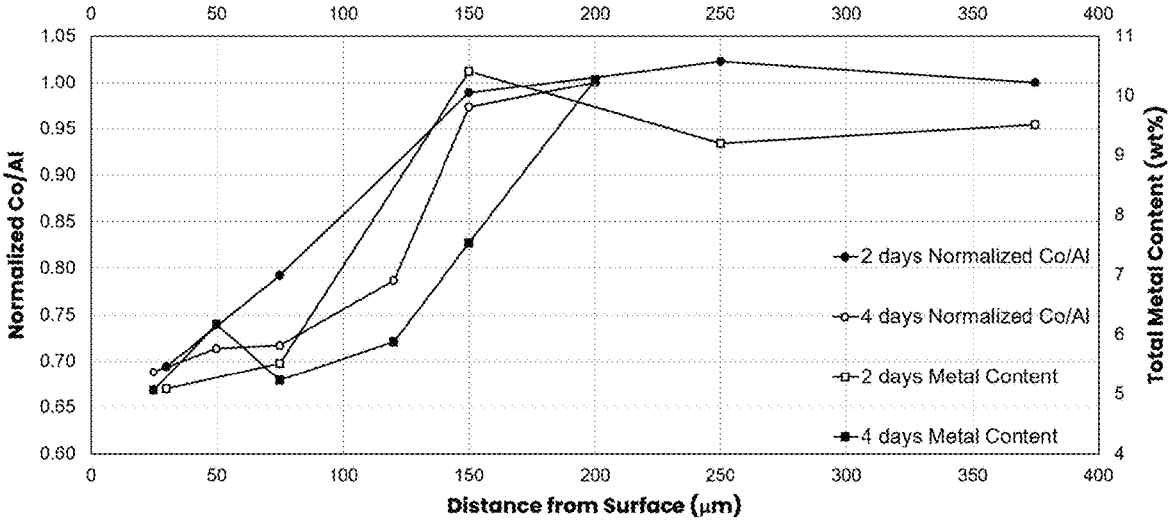
FIG. 7B is a graph depicting the depth of a leached region (first region) vs. the metal content of the cutting table of a selectively leached cutting element of an embodiment of the disclosure.

FIG. 7B shows the metal content of the element, specifically normalized cobalt/aluminum content and total metal content as a function of distance from the surface for different leaching process durations, in particular a 2-day leach and a 4-day leach. The leaching agent utilized for the etching illustrated in the micrographs of FIG. 7A and the chart of FIG. 7B may include composition comprising hydrogen chloride (HCl) and/or nitric acid ($HNO_3$). For example, the leaching agent composition may comprise 1 part by volume HCl and 3 parts by volume $HNO_3$. The acids (e.g., HCl and $HNO_3$) may be reagent grade in purity and concentration. Additionally, the temperature of the leaching agent composition may be from about 65.5° C. (about 150° F.) to about 93° C. (about 200° F.), such as about 82° C. (about 180° F.). The depth of the leach layer may be measured, as in FIG. 7B, using Energy-dispersive X-ray spectroscopy (EDS) by determining the phase ratios of cobalt to aluminum present in the cutting element 300, 300'. For example, the region subjected to a leaching agent exhibits lower amounts of cobalt and aluminum phases indicating the region has been leached and a leach layer depth measured from the surface can be determined. The leached layer of a cutting element subjected to a 2-day leach measures about 84 microns from the surface, whereas the leached layer of an element subjected to a 4-day leach measures about 126 microns from the surface as shown in the graph of FIG. 7B. The total metal content of the leached layer measuring about 84 microns of a cutting element subjected to a 2-day leach is about 5.5 wt %. The total metal content of the leached layer measuring about 126 microns of the cutting element after a 4-day leach is about 6 wt %.

Figures 8A, 8B:
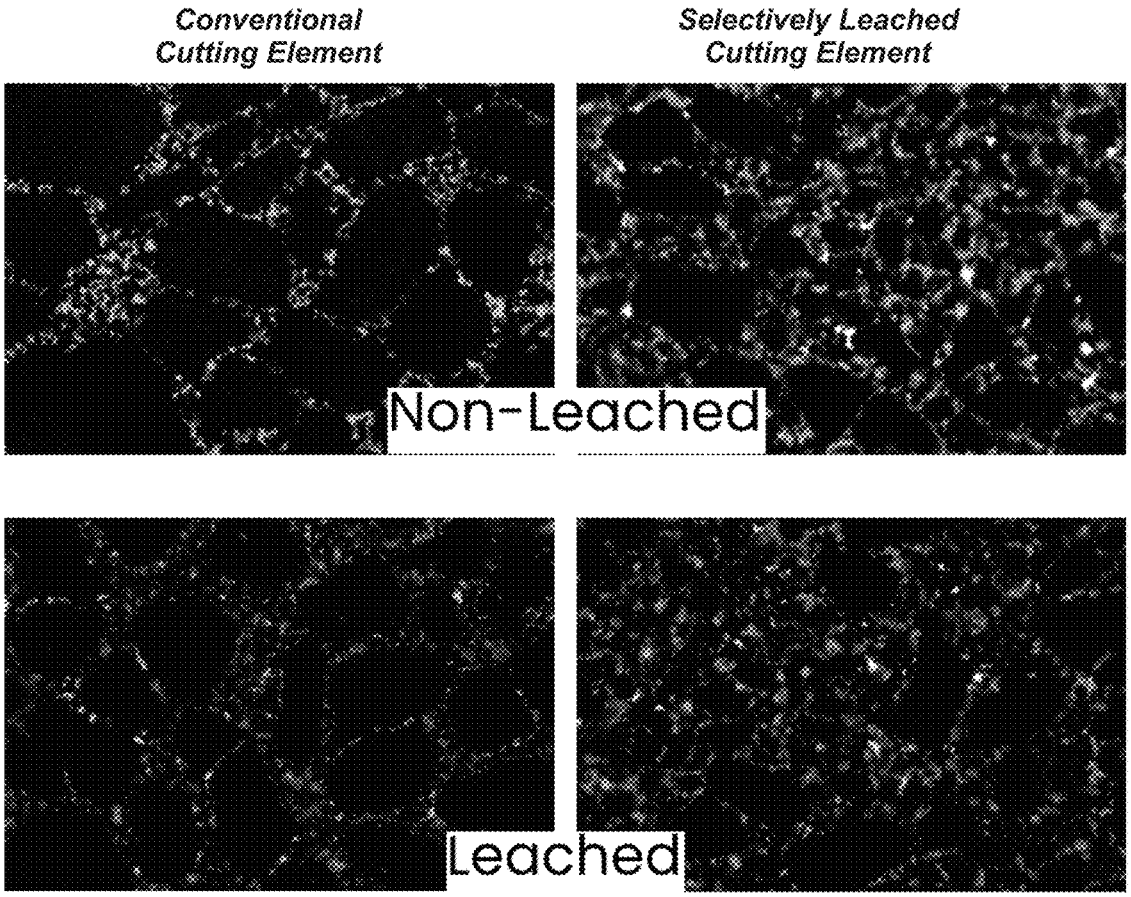
FIG. 8A is a series of photomicrographs showing the microstructural comparison of a non-leached region vs. a leached region of a cutting table of a selectively leached cutting element of an embodiment of the disclosure compared to a conventional cutting element.
FIG. 8B is a table comparing the metal content of a non-leached region vs. a leached region of a cutting table of a selectively leached cutting element of an embodiment of the disclosure compared to a conventional cutting element.

FIGS. 8A and 8B are a series of photomicrographs showing and accompanying data of the microstructural comparison of a non-leached region vs. a leached region of a cutting table of a selectively leached cutting element of the disclosure compared to like regions of a conventional cutting element. Referring to FIG. 8A, the image in the top left corner is of a portion of a conventional cutting element formed using a Group VIII metal catalyst that has not been subjected to leaching. The image in the bottom left corner is of a portion of the conventional cutting element that has been subjected to leaching. The image at the top right corner is of a portion of cutting element according to the disclosure prior to leaching. The image in the bottom right corner is of a cutting element of the disclosure after leaching. With reference to FIG. 8B, the table provides data showing that the total metal content of first region of a selectively leached cutting element of the disclosure is greater than the total metal content of a conventional leached structure, both before a leaching process and after a leaching process, as well as a lower reduction in catalytic metal (e.g., Co) weight content after leaching. For example, the total metal content (in wt %) of conventional leached cutting elements is about 2.45 wt %, whereas the selectively leached cutting element has a total metal content of about 5.09 wt %.

Figure 9:
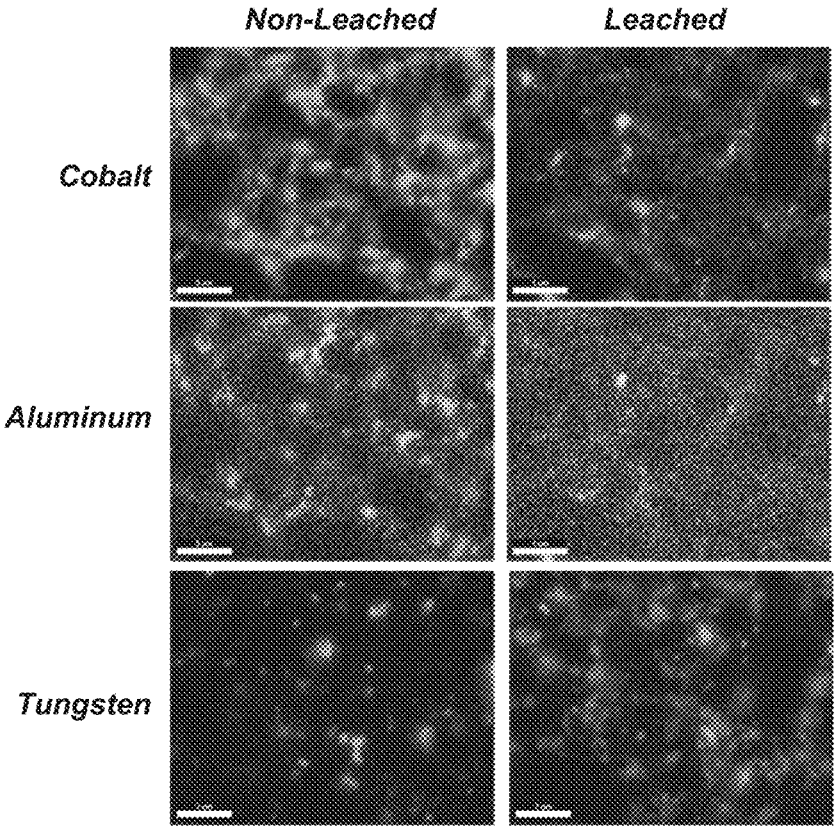
FIG. 9 is a series of photomicrograph images showing metal content of a non-leached region vs. a leached region of a cutting table of a selectively leached cutting element of an embodiment of the disclosure.

FIG. 9 is a series of images showing the metal content of a non-leached region vs. a leached region of a selectively leached thermally stable cutting element of the disclosure. The series of images show that there is a high reduction in cobalt, a moderate reduction in aluminum, and a high elevation in tungsten in a leached (e.g., first) region of the cutting element. Cobalt in the final structure is undesirable due to its highly catalytic nature in metallic phases and therefore is significantly targeted for removal from a region of the cutting table by a leaching agent.

Figure 10A:
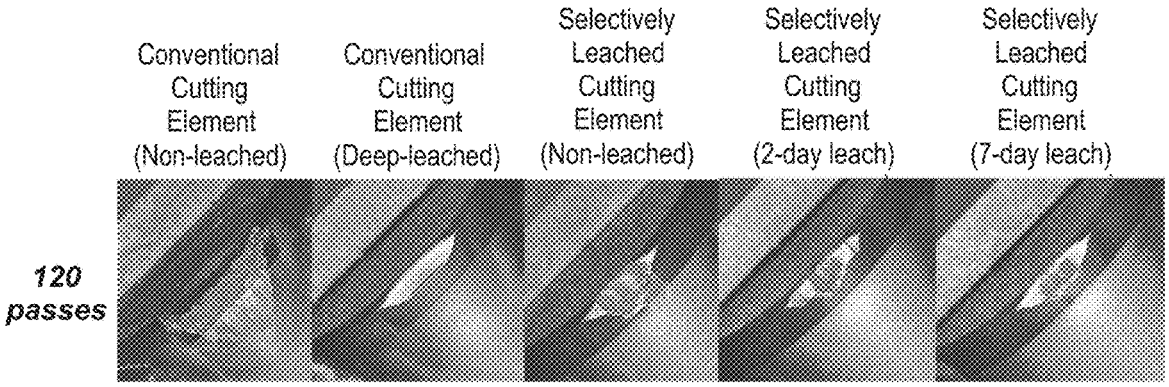
FIG. 10A is a series of images showing cutting results of a selectively leached cutting element of an embodiment of the disclosure compared to a conventional cutting element.
Figure 10B:
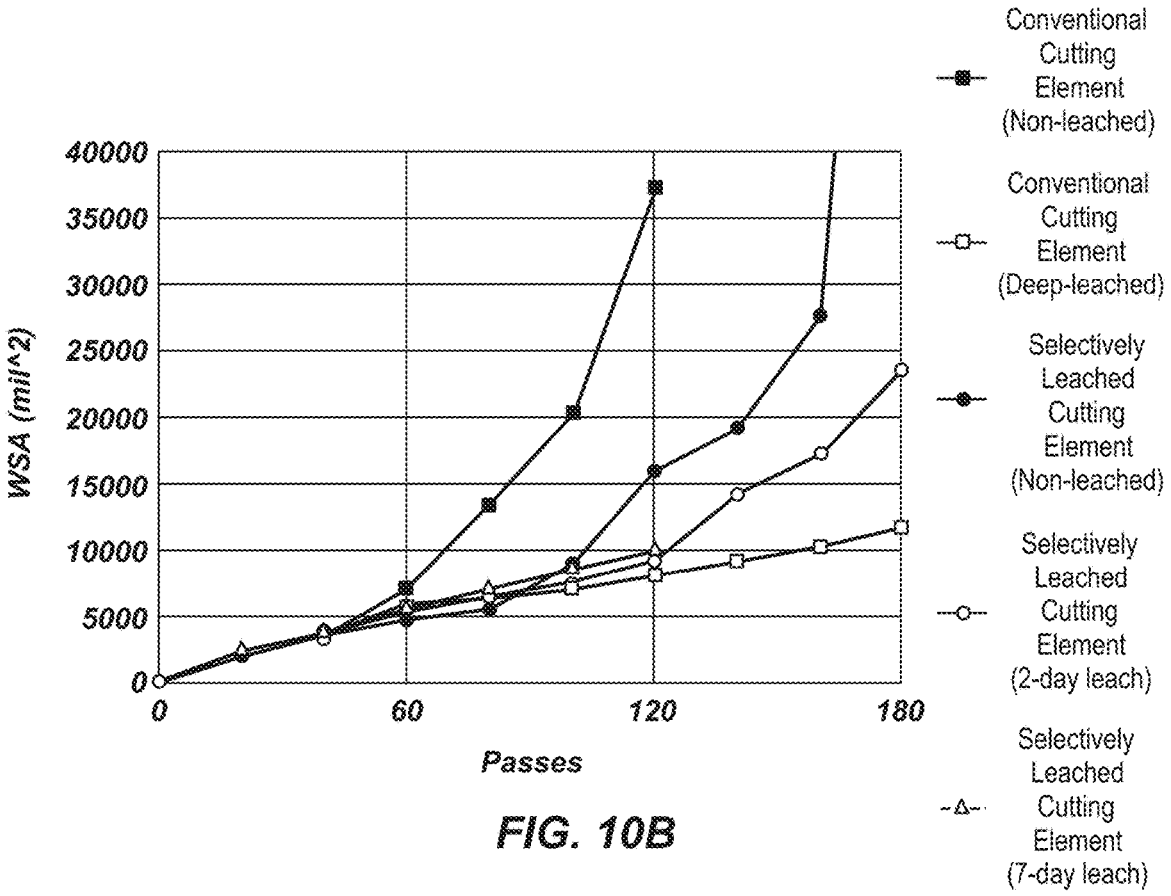
FIG. 10B is a graph comparing the wear scar area (WSA) vs. number of passes of the cutting table of a selectively leached cutting element of an embodiment of the disclosure compared to a conventional cutting element.

FIGS. 10A and 10B are a series of images representing wear results of a selectively leached cutting element of the disclosure compared to a conventional partially leached cutting element and the accompanying data. FIG. 10A represents the visual results of a performance test where the mechanical properties of the cutting elements is tested. For conventionally leached cutting elements, a deep leach may be from about 700 μm to about 1000 μm. Cutting elements that have been selectively leached for about 2 days may have a leach depth from about 80 μm to about 90 μm (e.g., about 84 μm). Cutting elements that have been selectively leached for about 7 days may have a leach depth from about 170 μm to about 210 μm (e.g., about 189 μm). With reference to FIG. 10B, the graph shows the wear scar area (WSA) as a function of the number of testing passes. During testing, a single cutting element may be positioned at a prescribed back-rake angle and subjected to a constant depth-of-cut and infeed rate while engaging a rock specimen rotating at a substantially constant speed. As may be readily appreciated by those of ordinary skill in the art, while the WSA of a non-leached cutting element of the disclosure is substantially less than the WSA of a non-leached conventional cutting element, selective leaching of cutting elements of the disclosure further enhances reduction in WSA once selective leaching is performed.

Additional non-limiting example embodiments of the disclosure are described below.

Embodiment 1: A cutting element for an earth-boring tool, comprising a supporting substrate and a cutting table attached to an end of the supporting substrate. The cutting table comprising a first region and a second region. The first region comprising inter-bonded diamond particles and substantially free of at least highly catalytic metallic phases between the inter-bonded diamond particles, one or more non-catalytic compounds within interstitial spaces between the inter-bonded diamond particles, and voids within interstitial spaces between the inter-bonded diamond particles. The second region comprising inter-bonded diamond particles, the non-catalytic compound within interstitial spaces between the inter-bonded diamond particles, and metallic phases within interstitial spaces between the inter-bonded diamond particles. The first region of the cutting table has a content of elemental metal of at least about 2.6 wt %.

Embodiment 2: The cutting element of embodiment 1, wherein the one or more non-catalytic compound comprises a κ carbide precipitate having a general chemical formula, A3XZ, where A comprises one or more of Sc, Ti, V, Cr, Mn, Fe, Ni, Cu, Zn, Y, Zr, Nb, Mo, Tc, Ru, Rh, Pd, Ag, Cd, Hf, Ta, W, Re, Os, Ir, Pt, Au, Hg, La, Ce, Pr, Nd, Pm, Sm, Eu, Gd, Tb, Dy, Ho, Er, Tm, Yb, Lu, Ac, Th, Pa, and U; X comprises one or more of Al, Ga, Sn, Be, Bi, Te, Sb, Se, As, Ge, Si, B, and P; and Z comprises C.

Embodiment 3: The cutting element of embodiment 1 or embodiment 2, wherein a thickness of the first region of the cutting table is greater than about 50 μm.

Embodiment 4: The cutting element of any of embodiments 1 through 3, wherein the thickness of the first region of the cutting table is between about 150 μm and about 250 μm.

Embodiment 5: The cutting element of any of embodiments 1 through 4, wherein the metallic phases within interstitial spaces between the inter-bonded diamond particles of the second region of the cutting table comprises one or more of cobalt, iron, nickel and/or alloys thereof.

Embodiment 6: The cutting element of any of embodiments 1 through 5, wherein the first region of the cutting table has a content of elemental metal of from about 3 wt % to about 6 wt %.

Embodiment 7: The cutting element of any of embodiments 1 through 6, wherein the second region of the cutting table is substantially free of voids.

Embodiment 8: The cutting element of any of embodiments 1 through 7, wherein the cutting table has one or more of a radiused cutting edge and a chamfered cutting edge.

Embodiment 9: The cutting element of any of embodiments 1 through 8, wherein the cutting table exhibits a thickness within a range of from about 0.3 mm to about 5 mm.

Embodiment 10: The cutting element of any of embodiments 1 through 9, wherein the cutting table comprises an apex and at least one side surface extending from at least one location at or proximate an interface between the supporting substrate and the cutting table toward the apex. The at least one side surface of the cutting table extending at one or more angles within a range of from about 5 degrees to about 85 degrees relative to a side surface of the supporting substrate.

Embodiment 11: A method of forming a cutting element, comprising: providing a diamond-containing material over a substrate; sintering the diamond-containing material with a homogenized binder to form a cutting table; during the sintering, converting portions of the binder within interstitial spaces between the inter-bonded diamond particles into one or more non-catalytic compounds and one or more metallic phases; substantially removing an amount of at least highly catalytic metal phases of the one or more metallic phases from the cutting face of the cutting table to a selected depth to form a first region of the cutting table, comprising substantially only inter-bonded diamond particles, non-catalytic compounds and voids.

Embodiment 12: The method of embodiment 11, further comprising leaving a second region of the cutting table below the selected leach depth comprising inter-bonded diamond particles, one or more non-catalytic compounds and one or more metallic phases.

Embodiment 13: The method of embodiment 11 or embodiment 12, wherein selectively removing the amount of the at least highly catalytic metallic phases comprises leaching the one or more metallic phases from within the interstitial spaces between the inter-bonded diamond particles.

Embodiment 14: The method of embodiment 13, wherein leaching the one or more metallic phases comprises applying a leaching agent formulated to remove the one or more metallic phases without removing the one or more non-catalytic compounds.

Embodiment 15: The method of any of embodiments 13 through 14, wherein leaching the one or more metallic phases comprises subjecting the cutting table to a highly oxidizing leaching agent.

Embodiment 16: The method of any of embodiments 13 through 15, wherein leaching the one or more metallic phases further comprises subjecting the cutting table to the leaching agent, the leaching agent comprising $HNO_3$ and HCl.

Embodiment 17: The method of any one of embodiments 13 through 15, wherein leaching the one or more metallic phases further comprises subjecting the cutting table to the leaching agent, the leaching agent comprising $H_2SO_4$ and $H_2O_2$.

Embodiment 18: The method of any of embodiments 11 through 17, further comprising selecting the depth from the cutting face of the cutting table to be greater than about 50 μm.

Embodiment 19: The method of any of embodiments 11 through 18, further comprising selecting the depth from the cutting face of the cutting table to be in a range from about 100 μm to about 250 μm.

Embodiment 20: An earth-boring tool comprising one or more of the cutting elements of any of embodiments 1 through 10.

While the disclosed device structures and methods are susceptible to various modifications and alternative forms in implementation thereof, specific embodiments have been shown by way of example in the drawings and have been described in detail herein. However, it should be understood that the present disclosure is not limited to the particular forms disclosed. Rather, the present invention encompasses all modifications, combinations, equivalents, variations, and alternatives falling within the scope of the present disclosure as defined by the following appended claims and their legal equivalents.

What is claimed is:

1. A cutting element for an earth-boring tool, comprising:

a supporting substrate; and a cutting table attached to an end of the supporting substrate, and comprising:

a first region comprising:

inter-bonded diamond particles, wherein the first region is substantially free of catalytic metallic phases between the inter-bonded diamond particles;

one or more non-catalytic compounds within interstitial spaces between the inter-bonded diamond particles; and voids within interstitial spaces between the inter-bonded diamond particles; and a second region comprising:

inter-bonded diamond particles;

the one or more non-catalytic compounds within interstitial spaces between the inter-bonded diamond particles; and one or more catalytic metallic phases within interstitial spaces between the inter-bonded diamond particles, wherein the first region of the cutting table has a content of elemental metal of at least about 2.6 wt %.

2. The cutting element of claim 1, wherein the one or more non-catalytic compounds comprise a K-carbide precipitate having a general chemical formula:

$$A_3XZ_{1-d}$$

where $0 \leq d \leq 0.5$;

A comprises one or more of Sc, Ti, V, Cr, Mn, Fe, Ni, Cu, Zn, Y, Zr, Nb, Mo, Tc, Ru, Rh, Pd, Ag, Cd, Hf, Ta, W, Re, Os, Ir, Pt, Au, Hg, La, Ce, Pr, Nd, Pm, Sm, Eu, Gd, Tb, Dy, Ho, Er, Tm, Yb, Lu, Ac, Th, Pa, and U;

X comprises one or more of Al, Ga, Sn, Be, Bi, Te, Sb, Se, As, Ge, Si, B, and P; and Z comprises C.

3. The cutting element of claim 1, wherein a thickness of the first region of the cutting table is greater than about 50 μm.

4. The cutting element of claim 1, wherein the first region comprises an interior portion and an exterior portion, wherein a thickness of the interior portion of the first region of the cutting table is from about 50 μm to about 1500 μm, and wherein a thickness of the exterior portion of the first region of the cutting table is from about 1000 μm to about 4000 μm.

5. The cutting element of claim 1, wherein the catalytic metallic phases within interstitial spaces between the inter-bonded diamond particles of the second region of the cutting table comprise one or more of cobalt, iron, nickel and/or alloys thereof.

6. The cutting element of claim 1, wherein the content of elemental metal of the first region of the cutting table is within a range of from about 3 wt % to about 6 wt %.

7. The cutting element of claim 1, wherein the second region of the cutting table is substantially free of voids.

8. The cutting element of claim 1, wherein the cutting table has one or more of a radiused cutting edge and a chamfered cutting edge.

9. The cutting element of claim 1, wherein the cutting table exhibits a thickness within a range of from about 0.3 mm to about 5 mm.

10. The cutting element of claim 1, wherein the cutting table comprises:

an apex; and at least one side surface extending from at least one location at or proximate an interface between the supporting substrate and the cutting table toward the apex, the at least one side surface extending at one or more angles within a range of from about 5 degrees to about 85 degrees relative to a side surface of the supporting substrate.

11. An earth-boring tool comprising one or more of the cutting elements of claim 1.

12. A method of forming a cutting element, comprising:

providing a diamond-containing material over a substrate;

sintering the diamond-containing material with a homogenized binder to form a cutting table attached to an end of the substrate and comprising inter-bonded diamond particles;

during the sintering, converting portions of the homogenized binder within interstitial spaces between the inter-bonded diamond particles into one or more non-catalytic compounds and one or more metallic phases comprising one or more catalytic metallic phases; and selectively removing the one or more catalytic metallic phases from the cutting table to form a first region substantially free of catalytic metallic phases and comprising inter-bonded diamond particles and the non-catalytic compounds and voids within the interstitial spaces between the inter-bonded diamond particles of the first region, and a second region comprising inter-bonded diamond particles and the one or more non-catalytic compounds and the one or more catalytic metallic phases within interstitial spaces between the inter-bonded diamond particles of the second region, wherein the first region of the cutting table has a content of elemental metal of at least about 2.6 wt %.

13. The method of claim 12, wherein the first region extends between a cutting face of the cutting table and a leach depth.

14. The method of claim 12, wherein selectively removing the one or more catalytic metallic phases comprises leaching the one or more catalytic metallic phases from within the interstitial spaces between the inter-bonded diamond particles of the first region.

15. The method of claim 14, wherein leaching the one or more catalytic metallic phases comprises applying a leaching agent formulated to remove the one or more catalytic metallic phases without removing the one or more non-catalytic compounds, the leaching agent comprising HCl, $HNO_3$, HF, $H_2SO_4$, $HClO_4$, or combinations or sub-combinations thereof.

16. The method of claim 14, wherein leaching the one or more catalytic metallic phases comprises subjecting the cutting table to a highly oxidizing leaching agent.

17. The method of claim 14, wherein leaching the one or more catalytic metallic phases comprises subjecting the cutting table to a leaching agent, the leaching agent comprising from about 1 part by volume $HNO_3$ and 3 parts by volume HCl, to from about 3 parts by volume $HNO_3$ and 1 part by volume HCl.

18. The method of claim 14, wherein leaching the one or more catalytic metallic phases comprises subjecting the cutting table to a leaching agent, the leaching agent comprising from about 3 parts by volume $H_2SO_4$ and about 1 part by volume $H_2O_2$ to about 7 parts by volume $H_2SO_4$ and about 1 part by volume $H_2O_2$.

19. The method of claim 12, further comprising selecting the first region to extend to a depth from a cutting face of the cutting table of greater than about 50 μm.

20. The method of claim 12, further comprising selecting the first region to extend from a cutting face of the cutting table to a depth of within about 750 μm to about 1000 μm from an interface between the cutting table and the substrate.

* * * * *